US006417607B1

(12) United States Patent
Thielen

(10) Patent No.: US 6,417,607 B1
(45) Date of Patent: Jul. 9, 2002

(54) COLD ELECTRODE FOR GAS DISCHARGES

(76) Inventor: Marcus Thielen, Winkelhauser Strasse 81, D-47228 Duisburg (DE)

( * ) Notice: Subject to any disclaimer, the term of this patent is extended or adjusted under 35 U.S.C. 154(b) by 0 days.

(21) Appl. No.: 09/180,339

(22) PCT Filed: Feb. 28, 1998

(86) PCT No.: PCT/DE98/00595

§ 371 (c)(1),
(2), (4) Date: Nov. 5, 1998

(87) PCT Pub. No.: WO98/39791

PCT Pub. Date: Sep. 11, 1998

(30) Foreign Application Priority Data

Mar. 5, 1997 (DE) ..... 297 03 990 U

(51) Int. Cl.[7] ..... H01J 19/14
(52) U.S. Cl. ..... 313/339; 313/337; 313/341
(58) Field of Search ..... 313/339, 631, 313/632, 340, 633, 630, 634, 341, 345, 355, 346 R, 346 DC, 491, 523, 531, 542

(56) References Cited

U.S. PATENT DOCUMENTS

| | | | | |
|---|---|---|---|---|
| 3,366,827 A | * | 1/1968 | Bakker | 313/340 |
| 3,582,702 A | | 6/1971 | Almer | |
| 3,641,298 A | * | 2/1972 | Broverman | 200/166 C |
| 4,117,374 A | | 9/1978 | Witting | |
| 4,620,128 A | | 10/1986 | Luthra | |
| 5,111,108 A | | 5/1992 | Goodman et al. | |
| 5,905,334 A | * | 5/1999 | Nakamura et al. | 313/491 |

FOREIGN PATENT DOCUMENTS

| | | |
|---|---|---|
| EP | 0136726 | 4/1985 |
| FR | 2543733 | 10/1984 |

OTHER PUBLICATIONS

Kittel, C.: "Introduction to Solid State Physics", Wiley & Sons, New York, 1986, pp. 16–21.

Zworykin, V.K. & Wilson, E.D.:"Photocells and Their Application", Wiley & Sons, New York, 1930, pp. 1–7, 30–41, 78–83, 98–105.

Miller, S.C., Fink, D.:"Neon Signs", McGraw–Hill, New York, 1935 pp. 44–45, 48–49, 54–55.

Miller, S.C.: "Neon Signs and Cold Cathode Lighting", McGraw–Hill, New York, 1952, pp. 38–49.

Gut: "Handbuch Der Lichtwerbung", Deutsche Verlags–Anstalt, Stuttgart, 1974, pp. 49–50.

Grimsehl: "Lehrbuch Der Physik", Teubner, Leipzig 1959, pp. 255–263.

Ardenne, Musiol, Reball: "Effekte Der Physik Und Ihre Anwendungen", Harri Deutsch, Frankfurt, 1990, pp. 208–210.

Pohl, R.W.: "Einführung In Die Optik", Springer, Berlin, 1943, pp. 198–201.

* cited by examiner

*Primary Examiner*—Vip Patel
*Assistant Examiner*—Joseph Williams
(74) *Attorney, Agent, or Firm*—Friedrich Kueffner

(57) ABSTRACT

Cold electrodes for gas discharges have an electrically conductive carrier material on which an emission coating is disposed. The photoelectric output work of the material of the emission coating is less than that of the carrier material or less than 5.6*10–19 joule/electron. The emission coating can, in particular, contain yttrium. The electrode preferably has the form of a hollow body and can be embedded in a glass body.

26 Claims, 2 Drawing Sheets

COLD ELECTRODE FOR GAS DISCHARGES

BACKGROUND OF THE INVENTION

1. Field of the Invention

The present invention relates to an electrode for gas discharges which comprises an electrically conductive material.

2. Description of the Related Art

Cold electrodes for gas discharges which exploit the hollow cathode effect have been known and in use for some time in industry, e.g. for electron tubes or lighting purposes. (U.S. Pat. No. 1,125,476; for hollow cathode effect, see literature, e.g. Manfred von Ardenne (editor); "*Effekte der Physik und ihre Anwendungen*"; Verlag Harri Deutsch; Thun, Frankfurt/Main, 1990).

Cold electrodes are usually provided on the inner surface with a coating comprising mixtures of alkaline earth metal oxides, hereinafter referred to as activation, to reduce the work function (principle of Wehnelt in 1907). Since the oxides are not stable under normal ambient conditions, the emission coatings are applied in the form of carbonates to the support material of the electrode and are converted into the corresponding oxides at low pressures and high temperatures, e.g. with ignition of the support material.

The electric losses of the above-described electrodes with the associated disadvantages are very dependent on the boundary conditions during conversion of the carbonates in the conditioning step and also on residual gases in the discharge chamber during operation, which reduce the emission capability ("poisoning of the activation").

SUMMARY OF THE INVENTION

It is therefore an object of the present invention to provide an electrode which is insensitive to the boundary conditions during processing and has low electric losses, and thus low heat evolution, during the entire life of the gas discharge device.

This problem is solved by the photoelectric work function of the material of the emission coating (3) being lower that that of the support material (1) in the region of the operating temperature of the electrode below 570 K, preferably below 420 K.

The key aspect of the solution according to the invention is accordingly that the coating of the electrode which emits the electrons ("emission coating") is selected in a particular way taking into account its photoelectric work function.

This work function should be less than that of the support material of the electrode over the operating temperature range of the electrode which is typically from 260 to 450 K. Regardless of the support material, the photoelectric work function should be less than $5.6\times10^{-19}$ joule/electron in the temperature range from 0 to 500 K. Specific coating materials which can be used are, according to claim 3, yttrium, praseodymium or rubidium or mixtures thereof.

The photoelectric work function is defined as the photoelectric quantum energy which has to be expended per electron to release the latter from the electrode (measured in eV/electron or joule/electron).

According to the invention, surfaces having a low and high photoelectric work function are combined. The electron-emitting layer can comprise metallic or semiconductor materials having a photoelectric work function lower than that of the support material in place of the oxides having a high photoelectric work function at low temperatures, often simultaneously exploiting the hollow cathode effect which is known in principle.

An advantage of the invention is the avoidance of an undesired chemical reaction on the electrode surface. This makes the electrode virtually independent of the gas atmosphere during manufacture and conditioning; it is neither possible for the activation composition to be poisoned nor for incomplete reaction during conversion to allow the release of reaction products into the atmosphere of the gas discharge chamber at a later point in time.

The use of appropriately chemically inert materials having a low photoelectric work function (e.g. yttrium) makes the electrode of the present invention largely secure against incorrect treatment during production and conditioning by, for example, untrained personnel. The avoidance of industrially very complicated preparation process for carbonate mixtures which was previously necessary can also lead to considerable cost advantages.

In addition, measurements indicated a considerably lower evolution of heat when operating the electrode of the invention compared to electrodes which were of the same dimensions and construction type but had been activated using oxide mixtures.

Measurements of the photoelectric work function at various temperatures demonstrate the considerably lower photoelectric work function of the electrode of the invention at an operating temperature of T=300 K (see FIG. 3).

Oxide mixtures have, when excited thermally, a low photoelectric work function. In the thermal emission of electrons from inhomogeneous, multicomponent, insulating solids whose electronic band structure has indirect transitions, lattice vibrations (phonons) participate in the excitation of the transitions at the minimum of the band gap (references: e.g. Joseph Eichmeier, "*Moderne Vakuumelektronik*", Springer Verlag, Berlin 1981).

For gas discharges using cold electrodes, the photoelectric work function has been found to be the critical parameter in determining the losses; under certain circumstances, it is different from the thermally determined work function. Since the phonon energy in cold electrodes is considerably lower than in thermally emitting electrodes, no indirect band transitions can be excited in the case of cold electrodes.

Coating materials of the invention have only almost direct band transitions and a small band gap which make participation of high-energy phonons in the excitation process dispensable.

In one embodiment of the invention, the electrode is configured as a hollow body, in particular cup-shaped, and the emission coating (3) is located on the inner surface of the hollow body. In this way, the hollow cathode effect can be exploited in a positive way in addition to the advantages of the coating of the invention. The hollow body can, in particular, have the shape of a cup and the emission coating is located on the inner surface of the hollow body where the emission of electrons takes place.

In a further embodiment of the hollow body electrode, the emission coating (3) has a lower photoelectric work function than the remaining surface of the electrode, in particular the outer surface of the hollow body. Electron emission is thus concentrated at the emission coating.

According to another embodiment of the invention, the support material (1) is provided on the outside of the hollow body with a surface layer (4), preferably of nickel or platinum, which has a high photoelectric work function, preferably higher than $8.0\times10^{-19}$ joule/electron. This advantageously allows an increase in the life of the electrode in operation by reducing the degree to which the discharge spreads to the outside of the support body and thus destroys it.

Another embodiment of the invention according to which the support material (1) has a low photoelectric work function, preferably less than $6.4\times10^{-19}$ joule/electron, leads to the advantage that the special coating on the inner surface of the electrode chamber can be dispensed with since support material and coating material can be identical.

The support material preferably comprises a metal, in particular iron. It is particularly preferred that the support material consists of the metal.

The emission coating (3) can further comprise dopants for reducing the photoelectric work function compared to the pure material, preferably the dopants, for example, calcium, cesium or barium in concentrations of from $10^{-5}$ at % to 1 at %. In this way, a further reduction in the work function and thus the losses can be achieved by decreasing the band gap in the electronic band structure compared to the use of pure materials.

Further preference is given to part of the surface of the support material (1) being provided with an electrically insulating surface layer (4) to suppress an electron or ion current. This has the advantage of completely suppressing an electron current from the outer surface of the support material and thus increases the life of the electrode.

The parts of the electrode facing the gas discharge can be coated with an electrically insulating, heat- and vacuum-resistant material, preferably ceramic. This has the advantageous effect that atomization of the active material or the support material of the electrode, starting from the edge facing the gas discharge, is prevented.

According to the invention, an electrically insulating sleeve (9) which is provided with a collar can also be arranged in the opening of the hollow space formed by the electrode in such a way that the collar covers the edges of the opening in the direction of the gas discharge. This allows, particularly simultaneously with the above-described prevention of atomization, formation of a, for example, annular channel when using the electrode in cylindrical chambers made of insulating material to be achieved. It prevents damaging and therefore undesirable spreading of the discharge to the outer surface of the support body and the electrical leads.

The edge facing the gas discharge of the opening of the hollow space formed by the electrode can also be shaped in such a way that the electric field gradient at the opening is reduced, preferably by bending over or crimping. In this way, the atomization rate can be partially reduced without the need for a further manufacturing element.

In addition, the electrode can be surrounded by a glass body (8) which is preferably cylindrical in shape. In another preferred embodiment of the invention, the electrode can be centered in the glass body (8) by means of a ring (10) of insulating material which is a poor conductor of heat, preferably ceramic or mica. This makes it possible to achieve centering of the electrode in a cylindrical glass body to avoid fracture of the glass under mechanical stress (e.g. shock, impact) or under thermal stress from one side only, as could occur, for example, during conditioning of the electrode.

Furthermore, it is preferred that the at least partly field-free space in the interior of a metal cup, hollow cylinder or hollow cone is created. In this way, existing manufacturing tools of a design known per se are suitable for producing the shaped bodies of the device of the invention.

The device of the invention can also be configured such that a substance which binds reactive gases (getter) is applied to at least part of the surface of the support material (1) and is, for example, activated on conditioning the electrodes. This has the advantage that the noble gas atmosphere of a gas discharge is kept pure in operation by chemical and/or physical binding of any reactive gases or vapors released from the discharge vessel or electrode bodies.

The materials for coating the support material (1) can be applied in the form of hydrides, preferably as yttrium hydride. During conditioning of the electrodes, the hydrides are converted into the metallic form with liberation of hydrogen. This is advantageous because oxidation of reactive substances present in the discharge chamber is avoided during the baking-out and ignition procedure, as occurs in the regeneration of mercury-containing discharge lamps, e.g. high-voltage lighting tubes.

DESCRIPTION OF THE PREFERRED EMBODIMENTS

Figure 1:
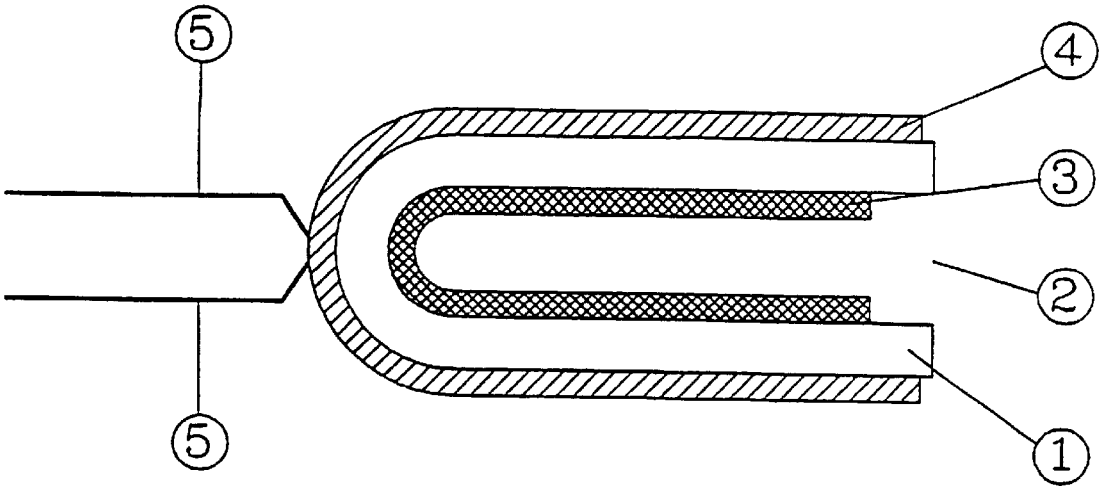
FIG. 1 shows an embodiment of the electrode according to the invention in longitudinal section.

The invention is described in more detail below with reference to the examples:

FIG. 1 shows an illustrative embodiment of the invention. The electrode is shown in longitudinal section. For the sake of clarity, the thicknesses of the layers are not shown to scale in the drawing.

The electrode of the invention comprises the support body (1) made of, for example, iron and configured by way of example in the shape of a cup and having an opening (2) facing the gas discharge.

The inner surface of the support body (1) is provided with a layer (3) of a material having a low photoelectric work function, e.g. yttrium, which has been applied by mechanical, chemical and/or physical coating methods (e.g. pressing-on, rolling-on, vapor deposition, sputtering, electrodeposition, spraying) while the outer surface (4) is coated, for example, with material having a high photoelectric work function, e.g. nickel or platinum.

At the closed end of the support body (1), here in the form of a hemispherical end, the electrical leads (5) are affixed in a manner known per se, e.g. by spot welding.

Figure 2:
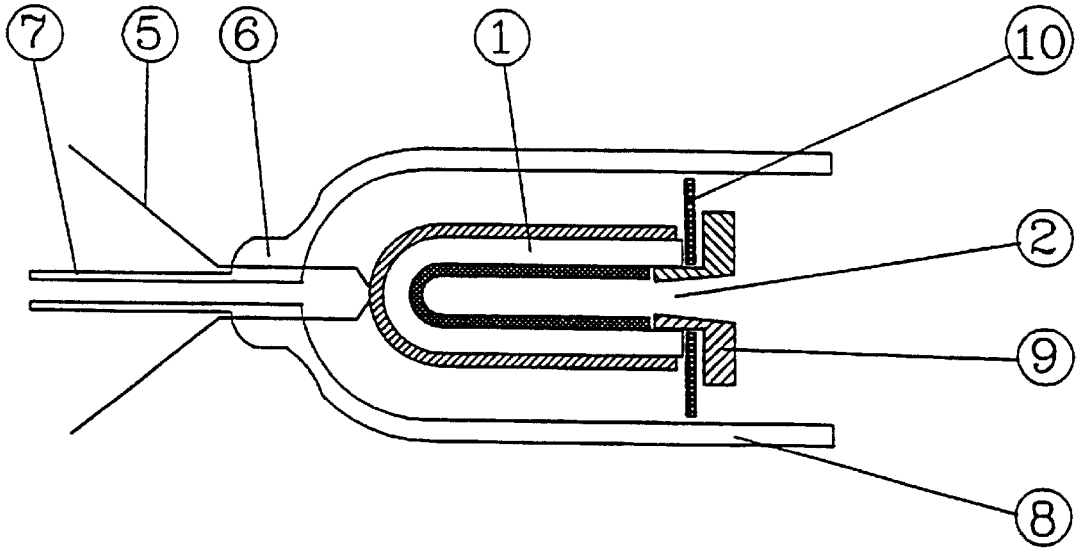
FIG. 2 shows an embodiment of the electrode according to the invention, installed in a cylindrical glass body, in longitudinal section.

FIG. 2 shows, by way of example, a longitudinal section through an electrode according to the invention installed in a cylindrical glass body (8) in a manner known per se as part of a gas discharge vessel for use in, for example, high-voltage lighting tubes. Here, the electrical leads (5) are sealed into the glass body (8) at the pinch base (6) so as to be vacuum-tight. A glass tube (7) additionally fused into the pinch base (6) can serve to evacuate the gas discharge vessel (not shown in FIG. 2). The electrode is usually fitted to the gas discharge vessel by means of the glass body (8).

Furthermore, FIG. 2 shows the opening (2) of the support body (1) with an insulating protective ring (9), for example of ceramic, which is fixed to the support body (1) in a manner known per se by pinching, rolling-in, knurling, rolling, etc.

Likewise shown by way of example is an additional centering ring (10) e.g. of mica, between protective ring (9) and support body (1). This guarantees that the electrode is seated centrally in the cylindrical glass body (8) . The centering ring (10) can, deviating from the circular shape, be provided, for example, with notches or the like in order to enable the gas discharge vessel to be readily evacuated through the connected tube (7).

Figure 3:
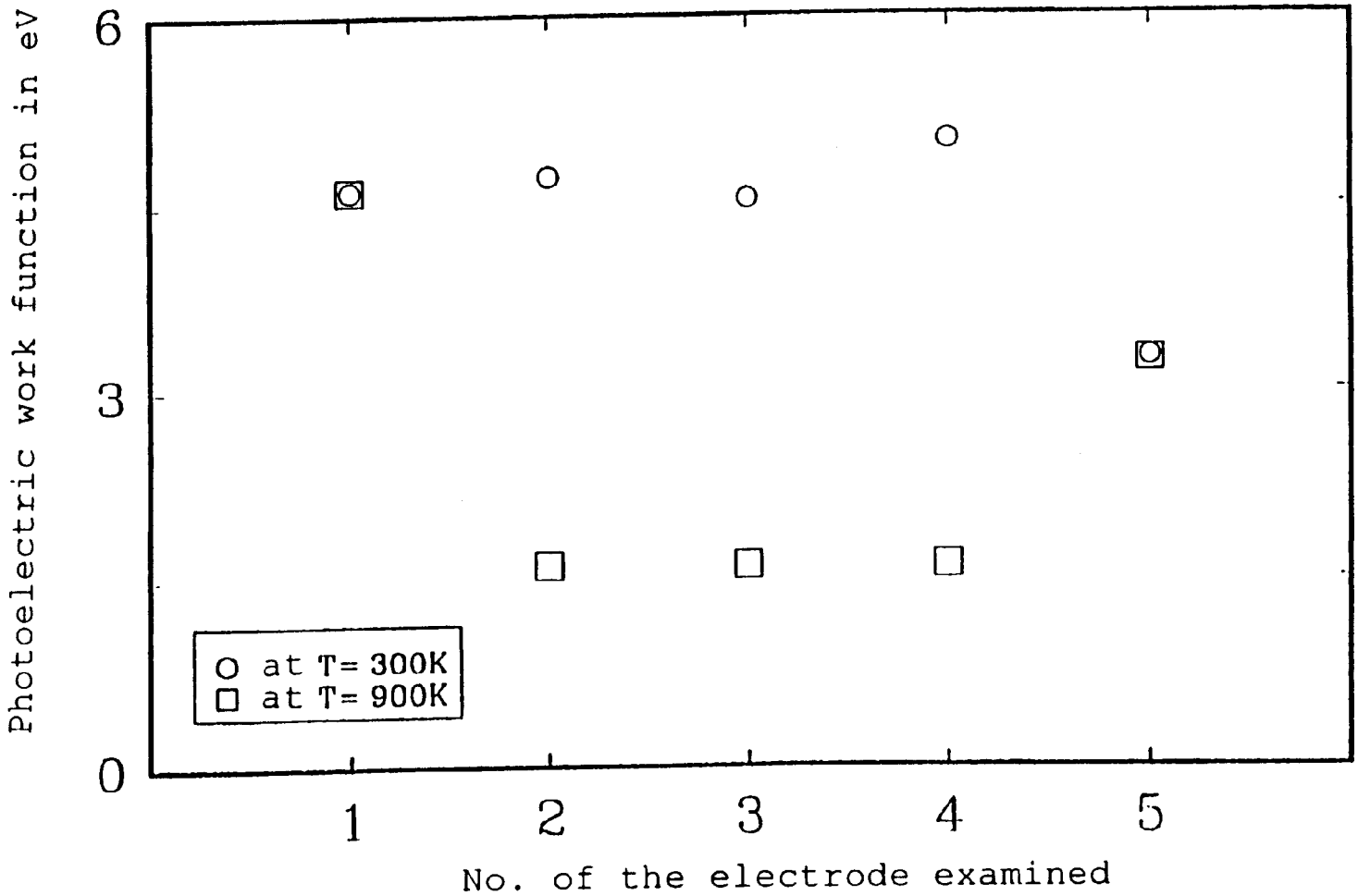
FIG. 3 illustrates measurements of the photoelectric work function of commercial electrodes in comparison to the electrode according to the invention.

FIG. 3 compares results of measurements of the photoelectric work function of various commercial electrodes compared to a design according to the invention.

In FIG. 3:

| No. of the electrode | Electrode construction (support material: iron) |
|---|---|
| 1 | without activating composition |
| 2 . . . 4 | commercial electrodes from various manufacturers having an activation composition comprising alkaline earth metal oxides |
| 5 | electrode according to the invention having an activation composition comprising yttrium |

What is claimed is:

1. An electrode for gas discharges which comprises an electrically conductive support material (1) on which there is located an emission coating (3) comprising a photoemissive material, wherein the photoelectric work function of the photoemissive material of the emission coating (3) is less than that of the support material (1) in the region of the operating temperature of the electrode below 570 K.

2. An electrode as claimed in claim 1, wherein the emission coating (3) comprises a conductive or semiconductor material.

3. An electrode as claimed in claim 1, wherein the electrode is configured at least in part as a hollow body, in particular cup-shaped, and the emission coating (3) is located on the inner surface of the hollow body.

4. An electrode as claimed in claim 3, wherein the emission coating (3) has a lower photoelectric work function than the remaining surface of the electrode.

5. An electrode as claimed in claim 3, wherein the support material (1) is provided on the outside of the hollow body with a surface layer (4), which has a photoelectric work function higher than $8.0\times10^{-19}$ joule/electron.

6. An electrode as claimed in claim 5, wherein the surface layer (4) is comprised of nickel or platinum.

7. An electrode as claimed in claim 3, wherein the parts of the electrode facing the gas discharge are coated with an electrically insulating, heat- and vacuum-resistant material.

8. An electrode as claimed in claim 7, wherein the electrically insulating, heat- and vacuum resistant material is ceramic.

9. An electrode as claimed in claim 3, wherein the edge facing the gas discharge of the opening of the hollow space formed by the electrode is shaped in such a way that the electric field gradient at the opening is reduced.

10. An electrode as claimed in claim 3, wherein the hollow body is a metal cup, hollow cylinder or hollow cone and has an interior, wherein the interior creates an at least partly field-free space.

11. An electrode as claimed in claim 1, wherein the support material (1) has a relatively low photoelectric work function of less than $5.6\times10^{-19}$ joule/electron.

12. An electrode as claimed in claim 1, wherein the support material (1) is iron.

13. An electrode as claimed in claim 1, wherein the emission coating (3) comprises dopants for reducing the photoelectric work function compared to the pure material in concentrations of from $10^{-5}$ at % to 1 at %.

14. An electrode as claimed in claim 13, wherein the dopants are cesium, calcium, or barium or mixtures thereof.

15. An electrode as claimed in claim 1, wherein part of the surface of the support material (1) is provided with an electrically insulating surface layer (4) to suppress an electron or ion current.

16. An electrode as claimed in claim 1, wherein an electrically insulating sleeve (9) which is provided with a collar is arranged in the opening of the hollow space formed by the electrode in such a way that the collar covers the edges of the opening in the direction of the gas discharge.

17. An electrode is claimed in claim 1, wherein the electrode is surrounded by a cylindrical glass body (8).

18. An electrode is claimed in claim 17, wherein the electrode is centered in the glass body (8) by means of a ring (10) of insulating material which is a poor conductor of heat.

19. An electrode as claimed in claim 18, wherein the ring (10) of insulating material is comprised of ceramic or mica.

20. An electrode as claimed in any of claim 1, wherein a substance which binds reactive gases (getter) is applied to at least part of the surface of the support material (1).

21. An electrode is claimed in claim 1, wherein the materials for coating the support material (1) are applied in the form of hydrides, which are converted into the metallic form with liberation of hydrogen during conditioning of the electrodes.

22. An electrode as claimed in claim 21, wherein the material for coating the support material (1) is yttrium hydride.

23. An electrode as claimed in claim 1, wherein the operating temperature of the electrode is below 420K.

24. An electrode for gas discharges which comprises an electrically conductive support material (1) on which there is located an emission coating (3) comprising a photoemissive material, wherein the photoelectric work function of the photoemissive material of the emission coating (3) is less than $5.6\times10^{-19}$ joule/electron in the temperature range from 200 to 500 K.

25. An electrode according to claim 24, wherein the photoemissive material is elemental yttrium, elemental praseodymium, elemental cerium or elemental rubidium or a mixture thereof.

26. An electrode as claimed in claim 24, wherein the photoelectric work function of the material of the emission coating (3) is less than $5.6\times10^{19}$ joule/electron in the temperature range of 260K to 450K.

* * * * *